United States Patent [19]

Moolenaars

[11] 4,062,090

[45] Dec. 13, 1977

[54] SEALING DEVICE

[76] Inventor: Jan Eric Moolenaars, Dillenburglaan 2, Velp, Netherlands

[21] Appl. No.: 722,503

[22] Filed: Sept. 13, 1976

[30] Foreign Application Priority Data

Sept. 19, 1975 Netherlands ..... 7511081

[51] Int. Cl.[2] ..... A44B 19/30

[52] U.S. Cl. ..... 24/205.11 L; 292/307 R

[58] Field of Search ..... 24/205.11 L; 292/307; 403/2

[56] References Cited

U.S. PATENT DOCUMENTS

| | | | |
|---|---|---|---|
| 2,272,681 | 2/1942 | Smith | 24/205.11 L |
| 2,530,899 | 11/1950 | Mueller | 292/307 R |
| 2,942,450 | 6/1960 | Krug | 24/205.11 L |
| 3,138,842 | 6/1964 | Arthur | 24/205.11 L |
| 3,955,842 | 5/1976 | Edwards | 292/307 R |

FOREIGN PATENT DOCUMENTS

| | | | |
|---|---|---|---|
| 854,784 | 11/1960 | United Kingdom | 24/205.11 L |

*Primary Examiner*—Bernard A. Gelak

*Attorney, Agent, or Firm*—Browdy and Neimark

[57] ABSTRACT

A sealing device for a zip fastener, comprising a lock having therethrough a channel, of which a wall portion is resilient and into which can be inserted the shaft of a disposable sealing member comprising a head and a shaft under temporary deformation of the resilient wall portion, and then be retained therein secured against withdrawal and rotation, while the head fixes the pulling lip of the zip fastener and the pulling lip is provided with a rotatable disc having a receiving cavity for the head of the sealing member, all this in such a manner that as a result of rotation of the disc the shaft of the sealing member can be twisted to fracture.

8 Claims, 4 Drawing Figures

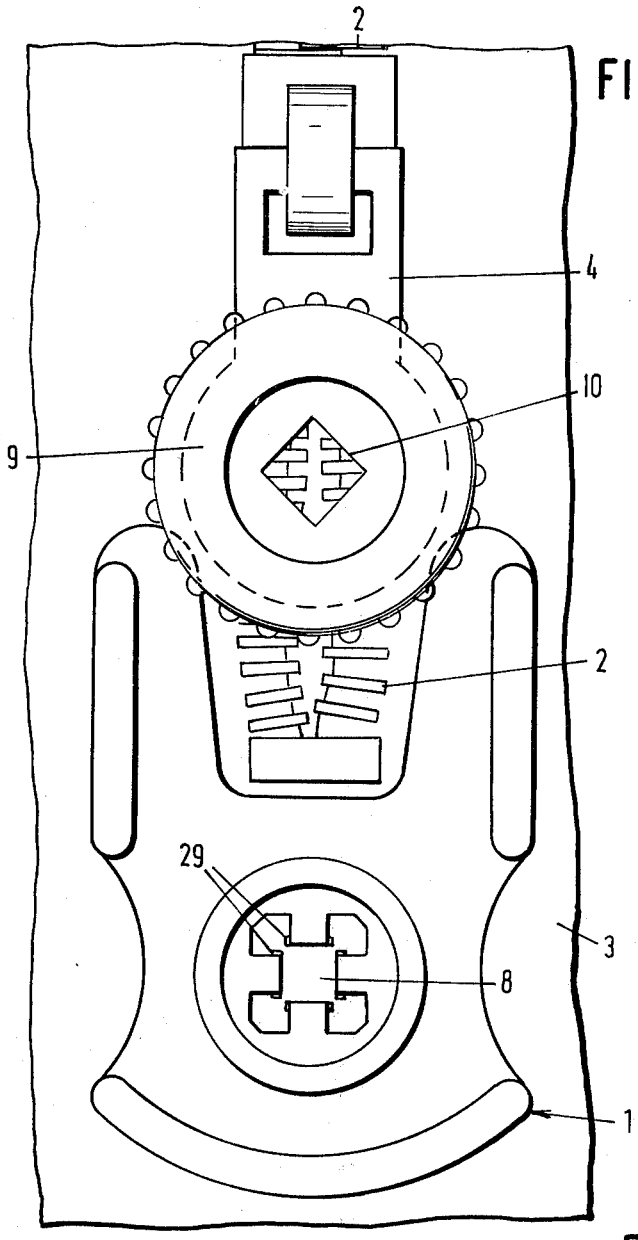
FIG.1
FIG.3
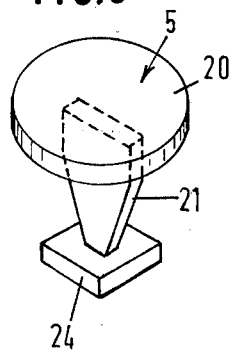
FIG.4
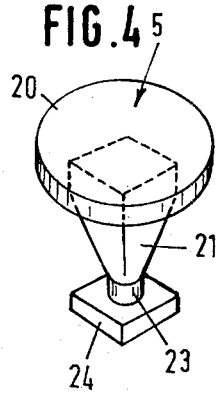
FIG.2
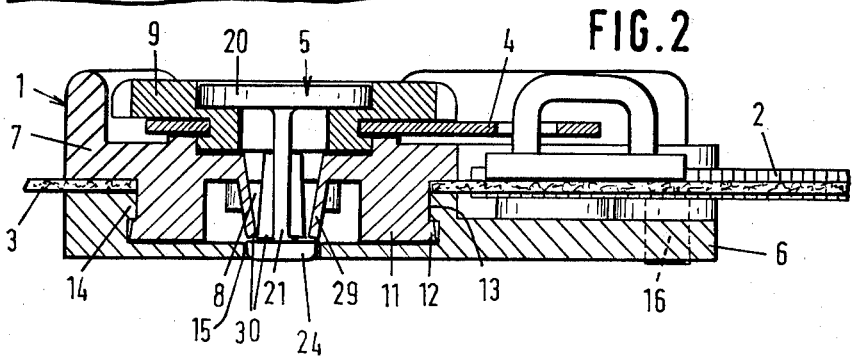

SEALING DEVICE

This invention relates to a sealing device for a zip fastener or the like, comprising a lock having extended therethrough a channel of at least locally unround cross-section, into which channel can be inserted a disposable, rupturable sealing member, which is composed of an at least locally unround shaft and a head, under temporary deformation of elastic means to be secured against rotation by cooperation of unround shaft and channel portions, while the head of the sealing member fixes the pulling lip of the slider of the zip fastener relative to the lock and means are present to twist at least the shaft portion of the sealing member adjacent the head relative to the free shaft end secured against rotation, and thus to break the seal.

BACKGROUND OF THE INVENTION

A like sealing device has been described in Dutch patent application 74,12131, which device is used for dispatching documents in transportation bags which mostly have the form of a flat envelope having along one of the edges a zip fastener which in closed position is sealed by means of the rupturable sealing member, on the one hand in order to render that the transportation bag can be opened less easily, but in particular in order to be able to establish afterwards that the transportation bag has been opened by a person unauthorized to do so.

With such a sealing device it should be possible to apply the sealing member quickly and without use of aids, and to clearly establish that the sealing member is broken.

In the sealing device known from this Dutch patent application the elastic means, which are deformed during insertion of the sealing member into the channel in the lock, are formed by resilient lips projecting from the shaft portion of the sealing member, and in the head of the sealing member there is formed a slit wherein a coin or special tool can engage for twisting said sealing member in order to break same.

It will be clear that this design leads to an increase of the cost price of sealing members.

The object of the invention is to provide a sealing device of the type as described above, in which no tool is required to break the sealing member thereof, while said sealing member is of simple construction and therefore can be produced cheaply.

According to the invention, for this purpose the resilient means are formed by a resilient portion of the channel wall, a boundary face of which serves as stop face for the enlarged free shaft end of unround configuration, which, when the sealing member is inserted, is received in a complementarily shaped channel portion, while the means for breaking said sealing member by twisting are connected with the pulling lip.

In a preferred embodiment of the invention for twisting the shaft of the sealing member there is rotatably connected with the pulling lip a disc which is provided with a recess for receiving secured against rotation the head end and/or the shaft portion connected to the head. The disc may be provided with a receiving cavity for the head of the sealing member and with an opening for passing an unround shaft portion thereof secured against rotation.

For breaking the seal one only need turn the disc, as a result of which the head end of the shaft of the sealing member is twisted relative to the free end extending in the channel secured against rotation until somewhere between head end and free shaft end the shaft is broken.

In order to avoid that upon breaking of the seal the broken-off end of the sealing member has to be removed from the lock before resealing can be effected, according to the invention the axial channel may extend throughout the lock. In that case the broken-off shaft portion falls from the bottom side of the lock. Nevertheless, in the sealing device according to the invention it is impossible to manipulate the sealing means or the resilient stop means from the bottom side in order to remove the sealing means without breaking same.

In order that the lock can be produced in a simple manner, and therefore cheaply, and be attached to a transportation bag, furthermore according to the invention it may consist of two essentially plate-shaped elements which, under inclusion of the material of the transportation bag at the end of the zip fastener, can be coupled together permanently be means of a snap-on connection in one or more places.

BRIEF DESCRIPTION OF THE DRAWINGS

Some embodiments of the sealing device according to the invention will now be described, by way of example, with reference to the accompanying drawings, wherein FIG. 1 is a top view of the sealing device before the sealing member is inserted;

FIG. 2 is a side view, partly in cross-section, of the sealing device according to FIG. 1 in closed condition; and FIGS. 3 and 4 show embodiments of the sealing member.

DESCRIPTION OF PREFERRED EMBODIMENTS

As is shown in the drawings, the sealing device consists of a lock 1 attached at the end of a zip fastener 2 of a transportation bag 3, of which is shown only a small portion. Reference numeral 4 indicates the pulling lip of the zip fastener and numeral 5 a sealing member.

Lock 1 of the sealing device is preferably composed of only two parts, namely a base plate 6 and an upper plate 7 which, under inclusion of the material of transportation bag 3, can be coupled together permanently by means of snap-on connections. An axial channel 8 extends through the combination of base plate 6 and upper plate 7. In pulling lip 4 is rotatably mounted a disc 9 wherein is made a square, at least unround, opening 10. At its bottom side upper plate 7 is provided with a projecting portion 11 having an outwardly extending flange edge 12 and a radially opening groove 13. Base plate 6 is provided with an upwardly opening ring groove which at the radial outside is defined by an edge flange 14, the relative size ratios being such that the projecting portion 11 of the upper plate can be snapped under edge flange 14 of the base plate, while edge flange 14 engages edge flange 12. Moreover, upper plate 7 is provided with pins 16 having an enlarged head, which can be snapped into recesses in the base plate. Therefore, the lock can be mounted in a simple manner by making an appropriate opening in the bag material, positioning base plate 6 at the bottom side thereof, applying at the top side upper plate 7, and pressing same vertically into base plate 6.

Sealing member 5 consists of a head 20 and a shaft 21. In the embodiment according to FIG. 4 shaft portion 21 has a relatively thin middle portion 23 and an end portion in the shape of a square block 24. Axial channel 8 is also square and has such dimensions that block 24 can be moved with some play through channel 8 but cannot undergo complete rotation therein. Resilient lips 29 extend obliquely downwardly into channel 8 in such a manner that upon insertion of shaft portion 21 of sealing member 5 into channel 8 block-shaped portion 24 is allowed to pass the yielding lips, but shaft portion 21 cannot be withdrawn since the end faces 30 of the resilient lips form a stop preventing the passage of block 24 in an upward direction.

When sealing member 5 is inserted (see FIG. 2), head 20 is countersunk in a recess made for it in disc 9, block 24 at the free end of shaft 21 is fittingly received in an opening 15 in base plate 6, and the shaft is received non-rotatably in opening 10 in disc 9.

In order to break the seal one turns disc 9 which for the purpose may be provided with an outer circumference roughened in any manner. Then, because block 24 cannot rotate in opening 15 whereas the shaft portion adjoining head 20 rotates with disc 9, shaft 21 will break at its weakest point, e.g. at 23.

It is not strictly necesary to make use of resilient lips 29 to prevent withdrawal of the shaft portion of the sealing member. For example, upper plate 7 may be made of such resilient material that in the position where in the embodiment shown lips 29 are present it will be sufficient to have a local constriction in channel 8, defined by stop faces 30, so that during insertion of sealing member 5 the channel wall portion in question can resiliently yield temporarily.

Furthermore the sealing device can be used, besides with zip fasteners, with any other types of closure, for example a lid closure.

I claim:

1. In a sealing device for a fastener having a pulling lip, the sealing device including a lock; a channel extending at least into said lock, having at least a portion thereof of uncircular cross-section and including wall means; a disposable rupturable sealing member which is to be inserted into said channel, said sealing member having a head and a shaft, said shaft having at least an end portion thereof which is of uncircular cross-section and said head being fixable to the pulling lip of the fastener; and means coupled to said sealing member for twisting at least that portion of said shaft adjacent said head relative to said end portion which is to be secured against rotation in said portion of said channel of uncircular cross-section for unsealing the device, the improvement wherein said wall means of said channel include at least one resilient portion thereby to allow said end portion of said sealing member to be forced past said resilient portion, said wall means including said resilient portion defining a boundary face which constitutes stop means for said end portion of said shaft when said end portion has been inserted into said channel and rests beneath said resilient portion of said wall means.

2. An improved device according to claim 1, wherein said means for twisting comprise a disc connected to said pulling lip, and said pulling lip includes a recess for receiving and holding at least said head of said sealing member.

3. An improved device according to claim 2, wherein said shaft of said sealing member includes an intermediate portion which is of uncircular cross-section, and said pulling lip includes a recess of uncircular cross-section for receiving and holding said intermediate portion of said shaft.

4. An improved device according to claim 1, wherein said shaft of said sealing member includes an intermediate portion which is of uncircular cross-section, and wherein said means for twisting comprises a disc provided with a cavity for receiving said head of said sealing member and an opening for passing said intermediate portion of said shaft secured against rotation.

5. An improved device according to claim 1, wherein said channel extends through said lock, whereby said end portion of said shaft and possibly part of said shaft may fall from the lock when the device is unsealed.

6. An improved device according to claim 1, wherein said lock comprises two plate-shaped elements and the device further comprises snap-on connection means for permanently coupling said plate-shaped elements together and to material of an article of which the fastener constitutes a part.

7. An improved device according to claim 1, wherein said fastener is a zip fastener, and including a transportation bag connected to said zip fastener and closeable thereby.

8. An improved device according to claim 1, wherein said sealing member is made entirely of substantially nonresilient, material.

* * * * *